US006526861B1

(12) United States Patent
Gruber

(10) Patent No.: US 6,526,861 B1
(45) Date of Patent: Mar. 4, 2003

(54) PROJECTILE STOPPING DEVICE

(75) Inventor: Heinz Gruber, Wilhelm-Busch-Strasse 2, D-38723 Seesen (DE)

(73) Assignee: Heinz Gruber, Seesen (DE)

( * ) Notice: Subject to any disclaimer, the term of this patent is extended or adjusted under 35 U.S.C. 154(b) by 0 days.

(21) Appl. No.: 09/554,154

(22) PCT Filed: Nov. 10, 1998

(86) PCT No.: PCT/EP98/07154

§ 371 (c)(1),
(2), (4) Date: May 9, 2000

(87) PCT Pub. No.: WO99/24775

PCT Pub. Date: May 20, 1999

(30) Foreign Application Priority Data

Nov. 12, 1997 (DE) ..... 197 49 881
Sep. 11, 1998 (DE) ..... 198 41 901

(51) Int. Cl.[7] ..... F41J 1/12; F41H 5/24
(52) U.S. Cl. ..... 89/36.04; 273/410
(58) Field of Search ..... 89/36.04, 36.02; 273/410

(56) References Cited

U.S. PATENT DOCUMENTS

| | | | | | |
|---|---|---|---|---|---|
| 3,197,207 | A | * | 7/1965 | Sanzare | 273/410 |
| 4,048,365 | A | * | 9/1977 | Hoover | 428/215 |
| 5,366,105 | A | * | 11/1994 | Kerman et al. | 220/62.11 |
| 5,405,673 | A | * | 4/1995 | Seibert | 428/137 |
| 5,486,425 | A | * | 1/1996 | Siebert | 428/500 |
| 5,738,925 | A | * | 4/1998 | Chaput | 428/101 |
| 5,749,177 | A | * | 5/1998 | Pontus et al. | 52/79.1 |
| 6,047,626 | A | * | 4/2000 | Lair et al. | 89/36.08 |

FOREIGN PATENT DOCUMENTS

| | | | |
|---|---|---|---|
| DE | 858 951 C | | 12/1949 |
| DE | 28 39 509 A | | 4/1980 |
| DE | 3209644 A1 | * | 9/1983 |
| DE | 88 13 708 U | | 3/1989 |
| DE | 40 22 327 A | | 1/1992 |
| DE | 44 10 342 A | | 9/1995 |
| DE | 4436060 A1 | * | 4/1996 |
| DE | 4441559 A1 | * | 5/1996 |

OTHER PUBLICATIONS

Patent Abstracts of Japan, vol. 013, No. 484 (M–886), Nov. 2, 1989 & JP 01 189499 A (Masao Kimura), Jul. 28, 1989 see abstract; figures.

* cited by examiner

*Primary Examiner*—Charles T. Jordan
*Assistant Examiner*—John W. Zerr
(74) *Attorney, Agent, or Firm*—Synnestvedt & Lechner LLP

(57) ABSTRACT

A projectile stopping device is proposed for the purpose of damping the noise propagation linked to the striking of projectiles, for the purpose of braking the projectiles and for easier recovery thereof, the individual stopping curtains (27 to 29) of which projectile stopping device, which are spaced apart from each other in the firing direction (1), consist of suspended steel cables. The stopping cables (26) are received in receiving devices which are identically formed at the top and bottom, and are thereby connected to guides (32) which are also formed in an identical manner to each other. The attachment of the stopping cables to these guides and their arrangement within a curtain are arranged in such a way that each stopping cable, when deflected, is always subject to a return force bringing it back into its original position. The projectiles striking the stopping curtains formed in this way within a firing field effect deflections of the steel cables both in the planes of the individual stopping curtains and also perpendicular thereto and can, after successful braking, be caught on the floor and sent for proper disposal.

24 Claims, 6 Drawing Sheets

PROJECTILE STOPPING DEVICE

The invention relates to a projectile stopping device for decelerating projectiles and recovering them for disposal purposes.

Irrespective of their intended purpose, which can be the practicing of shooting sports or shooting training for the police, military and similar security organizations, shooting ranges are provided with projectile stopping devices. These devices can be used in closed rooms or out in the open and should prevent unintentional or uncontrollable projectile movements outside the shooting range in that contacting projectiles should be braked (decelerated) to a stop without any occurrence of ricochet, and should be stopped in this way within a defined space limited by the projectile stopping device. The projectiles should also be recoverable in a simple and, in particular, complete manner in order to enable them to be disposed of properly.

The disposal of projectiles, which include at least a considerable considerable lead content is of great importance not only for economically motivated recycling reasons. The penetration of lead into the environment, whether via the groundwater in chemically dissolved form or via the air as lead dust holds considerable potential danger not least because of the dispersion paths which are difficult to monitor and the immediate results which cannot be estimated at present, but also subsequent damage and the many ways in which it could manifest itself and the long-term effects still to be anticipated.

Along with the growing environmental sensitivity, which has also been reflected in an increasing number of official publications for the operators of shooting installations, but also motivated by reasons of cost, there is therefore a requirement for a projectile stopping device able to meet the above-mentioned requirements.

Projectile stopping devices are basically known in the form of simple earth or sand mounds which, however, both from the point of view of the avoidance of heavy metal penetration into the earth and also the costly cleansing of earth loaded with heavy metals, are to be regarded as extremely questionable.

German Pat. No. DE-PS 858 951 discloses a projectile stopping device which consists of a stopping box formed from wood which, on the firing side, is covered by a target disc. Behind the target disc are a plurality of projectile stopping curtains located spaced apart from each other in the firing direction. These curtains consist in part of foam rubber and in part of another soft material, such as rubber, and are disposed in a freely hanging manner. A part of these plate-like stopping curtains is provided with vertical slits. A fundamentally similar projectile stopping device is known from German Pat. No. DE 28 39 509 A1, wherein the individual stopping curtains which lie one behind the other in the firing direction are formed by plates of hard rubber, which is reinforced with synthetic fiber mats or with woven wire. Alternatively, the use of an earth wall as the projectile stopping device is also known from this document. The stopping curtains consisting of rubber materials are encumbered by the problem that, in dependence upon the absolute thickness, projectiles remain stuck therein and must be separated by a special working process for disposal purposes. In addition, in dependence upon the frequency of firing, the further problem occurs of more or less severe wearing and therefore the necessity for the complete exchange of individual stopping curtains.

From German Pat. No. DE 88 13 708.2 a projectile stopping device is known, of which the individual stopping curtains are formed by a side by side arrangement of pipes, the walls of which are intended to be shot through and inside which are located further stopping bodies in the form of strip-like inserts in order to improve the stopping effect. Both the pipes and the strip-like inserts can, according to this document, consist of a rubber material reinforced by a woven fabric, such as parts from worn out conveyer belts. The pipes can, however, also consist of aluminum. An essential feature of this known projectile stopping device is therefore specially produced stopping bodies, wherein as a result of their formation intended to be shot through, the problem of disposing of the projectiles, in particular the separation of projectiles and projectile stopping material is again present.

Finally, a further projectile stopping device is known from German Pat. No. DE 44 10 342 A1, which in the main region consists, by virtue of an arrangement of plates at a spaced disposition one behind the other, of mutually spaced plates of rubber material reinforced by woven fabric, e.g. used parts of a conveyor belt, whereas the other regions, which are not subjected to comparably intensive firing, are characterized by a layered arrangement of projectile stopping blocks consisting, for example, of thermoplastic materials.

With respect to the disposal of the projectiles, in particular the separation of projectiles and projectile stopping material and with respect to wear, the statements already presented above in connection with the other projectile stopping devices of the prior art are true.

SUMMARY OF THE INVENTION

It is therefore the object of the invention to form a projectile stopping device of the type mentioned in the introduction in such a way that in addition to an operation which is safe and which harms the environment as little as possible, it is possible to catch the projectiles in a reliable manner and to dispose of the projectiles in a proper cost effective manner. This object is achieved in such a projectile stopping device according to the present invention which provides a projectile stopping device having a first stopping curtain and a second stopping curtain disposed behind the first stopping curtain relative to a firing direction. Each of the stopping curtains comprises a side by side arrangement of steel cables.

The projectile stopping device consists, amongst other things, of a plurality of stopping curtains disposed one behind the other in the firing direction. The curtains are intended to exert a braking effect (decelerate) on the projectiles coming into contact with them. The number of these stopping curtains is selected in dependence upon the maximum caliber or the maximum value of the projectile energy of the projectiles used and the braking capacity of the individual stopping curtain. In accordance with the invention, the individual stopping curtains consist of a side by side arrangement of steel cables, which by reason of their mechanical properties are particularly suited to being projectile stopping bodies. The act of firing at a steel cable which preferably hangs in such a way as to be able to swing, by reason of its composition of individual wire elements which are in frictional contact and therefore have a strong damping effect, is linked to an only moderate propagation of noise. According to its respective strength properties and the projectile energy to be received, the individual steel cable has a long service life within the projectile stopping device before an exchange is required. Contacting projectiles are braked in succession by the stopping curtains and simply fall to the floor between these curtains so that in conjunction with receiving containers on the floor an extremely simple recovery and disposal of the projectiles is possible. An expensive working process relating to separation of the projectiles from the stopping device is therefore avoided. Steel cables as the starting material for a stopping device in accordance with the invention are also found as waste materials in many machines and installations and are therefore available as an inexpensive raw material which must merely be cut to a length corresponding to the dimensions of the firing field. Steel cables are frequently found in a condition heavily soiled with lubricants which makes them undesirable for otherwise simple disposal as scrap metal. Accordingly, use of steel cables in accordance with the invention also allows for improved use of waste materials.

The steel cables of a stopping curtain can be disposed spaced apart from each other. In this case, a large number of stopping curtains are required in order to provide a gap-free covering of the firing field. In contrast, it is particularly advantageous if the steel cables of a stopping curtain are peripherally tangential to each other. This achieves a considerable increase in the braking property of the individual stopping curtain since a lateral displacement of an individual steel cable is always associated with a simultaneous displacement of other steel cables of the respective stopping curtain and consequently with a higher conversion of energy.

According to an embodiment of the present invention, the steel cables of the individual stopping curtains are disposed offset from each other in order to achieve a gap-free covering of the firing field, and in particular, both in the case of stopping curtains of which the steel cables are tangential to each other and also in those which are disposed laterally spaced from each other.

As a rule, the dimensions of the steel cables of a stopping curtain are of the same size. In dependence upon a desired braking property which—seen in the firing direction—can also be different, the parameters, characterizing the braking properties, of the steel cables of the stopping curtains can also differ accordingly. In addition to the cross-section or the weight, characterizing parameters may also include the characteristic strength values.

According to the features of another embodiment, the stopping curtains are hung on a transverse carrier mounted in such a way as to swing freely about a horizontal axis. This type of attachment of the stopping curtains improves the movement possibilities of the steel cables and their braking properties since the swinging movements of the transverse carrier and of the steel cable can be compounded and result in an extended deflection movement of the steel cable. A transverse carrier provided with stopping curtains can be provided—it is also possible for a plurality of transverse carriers to be provided which extend parallel to each other, can swing about their respective longitudinal axis and are each fitted with at least one stopping curtain.

According to the features of another embodiment, the steel cables are preferably releasably connected with the transverse carrier.

According to the features of another embodiment, the steel cables are suspended in such a way that they are free to swing to all sides. This is of particular significance for the steel cables located at the lateral edge regions.

In accordance with the features of another embodiment of the invention, the stopping cables take up a defined initial position within each stopping curtain, which position can be reproduced in the case of a deflection of the stopping cable as a result of firing since a return force returns the stopping cable to the initial position. This return force can be produced in the most simple case by spacers, thereby by means of an additional weight disposed on an end of the stopping cable. These spacers, however, have a further positive effect in that twisting of individual stopping cables is effectively prevented thereby. This in turn facilitates the exchange of individual damaged stopping cables. In the most simple case a spacer can be formed, for example, by a flat iron which is attached to stopping cables laterally, i.e. at the sides of two stopping cables facing each other within a stopping curtain.

According to the features of another embodiment of the invention, the stopping cables of the individual stopping curtains are guided at the top and bottom. The mechanical connections between the guides and the stopping cables are formed in such a way that the stopping cables can be deflected to a limited extent by projectiles striking them but during this deflection are subject to a return force towards their initial position. This return force can be gravity—but the possibility of suspending the stopping cables with intermediate positioning of tension springs should also be considered. As a rule, the stopping cables are disposed vertically, however, a horizontal arrangement is equally possible in this case. In each case a plurality of such stopping curtains are disposed one behind the other—seen in the firing direction, wherein the stopping cables of successive stopping curtains are disposed offset with respect to each other so that projectiles which strike between two stopping cables of a first curtain always undergo reliable braking by the stopping cables of the following stopping curtain. As a result of the stopping cables being guided at both sides and defined at both ends, by means of which the function of spacers is also provided, a simple exchange of individual stopping cables is possible since adjoining stopping cables can be prevented from twisting together as a result of being fired upon.

Maintenance work and down-times of the projectile stopping installation caused by such work can in this way be reduced with respect to the prior art.

According to the features of another embodiment, each stopping cable is provided at both ends with a receiving device to which it is firmly connected. In such an embodiment, the receiving device is adapted to the guide and is formed in such a way that a simple release of the connection between the receiving device on the one hand and the guide on the other hand is possible. The use of standardized receiving devices for the stopping cables, which are preferably formed in the same way at both ends, make it possible for each stopping cable to provide reproducible and in particular uniform deflection conditions with respect to a rest position. If required, a resilient element can be simultaneously integrated into the receiving device, by means of which element the stopping cable is connected to this receiving device.

The features of some embodiments of the present invention are directed at different types of physical arrangement of the stopping curtains with respect to the firing direction. In the most simple case, these stopping curtains are formed flat and the respective planes thereof extend normal to the firing direction. The plane of the individual stopping curtains can, however, also equally be disposed to pivot about a vertical axis with respect to the normal direction, wherein a pivot movement about a horizontal axis or about a horizontal and a vertical axis can also be provided. The different types of inclined arrangements of the stopping curtains offer the particular advantage that ricochets can be deflected over the shortest distance. It can also be of particular advantage in this connection that the projectile stopping device is formed by a plurality of groups of respectively planar stopping curtains, wherein the individual groups in turn extend at an angle to each other. This offers a particularly reliable stopping possibility even for ricochets or projectiles otherwise contacting the curtain at unusual angles.

According to the features of another embodiment, the stopping curtains can equally also extend along physically curved surfaces. This merely depends on the physical arrangement and formation of the guides allocated to the stopping cables. Also in this way, a stopping curtain can be produced, for example, which is formed in a U-shape, as seen in a horizontal cross-section.

The features of additonal embodiments of the invention are directed to an exemplified formation of a receiving device. This consists of a receiving part intended to receive a cable end and of a holding profile which is in preferably releasable connection with the receiving part. This connection can, for example, be a welded connection, wherein in the welding process the cable end facing the receiving part can be bound in at the same time.

According to additional features of the invention, each guide is formed by an arrangement of carrier pipes or rails which are disposed outside a target field. They can be disposed, for example, to be protected from contacting projectiles by cover plates. Both the carrier pipes and also the rails are naturally adapted to the actual formation of the holding profile, in particular to the permissible deflection movements of the stopping cables.

The features of still further embodiments of the invention are directed at the guide formed by the carrier pipes. The holding profile can, according to these embodiments, be formed in such a way, for example, that it passes through the intermediate space between two horizontally extending carrier pipes and a profile element of the holding profile engages over the top of the two carrier pipes. Alternatively, the profile part can also be formed in such a way that engagement takes place over only one carrier pipe. Such a formation of the element pairing: holding profile/carrier pipe is particularly advantageous where assembly and disassembly of a carrier cable is possible by a simple hanging movement of the holding profile perpendicular to the axis of the carrier pipe, in particular when the carrier pipes extend in the plane of the stopping curtain or of the curved surface, in which the stopping curtain extends. This facilitates, for example, removal and replacement of a stopping cable located in the middle of a stopping curtain. The guides can, however, equally also be formed by a plurality of comparatively short carrier pipes or comparable components which extend individually perpendicular to the plane or the surfaces of the stopping curtains so that from the end faces of the carrier pipes, the individual stopping cable or its holding device can be pushed on.

In another embodiment, all components of the projectile stopping device are held in a frame structure. The device as a whole can be designed to be set up in closed rooms, however, it is possible to consider setting it up in the open. In particular, it may also be a mobile installation.

The projectile stopping device can include a screen having plates and which frames the firing field. The plates should extend at an acute angle with respect to the firing direction and frame the firing field at least laterally and at the top. There may also be rearward and lateral enclosure of the arrangement of the stopping curtains with projectile proof plates, such as steel plates. These features are directed at limiting the firing field and the space receiving the stopping curtains. The screen forms a mechanical protection for the region to the side of the stopping curtains, amongst others also for the transverse carrier(s). By reason of its angled orientation it is ensured that no projectiles can ricochet back into the space in front of the projectile stopping device. The screen consists of projectile-proof plates which like side walls, which shut off the space behind the projectile stopping device and to the side thereof, can also consist of steel.

BRIEF DESCRIPTION OF THE DRAWINGS

The invention will be explained in more detail hereinunder with reference to the exemplified embodiments illustrated schematically in the following drawings, in which.

DETAILED DESCRIPTION OF THE INVENTION

Figure 1:
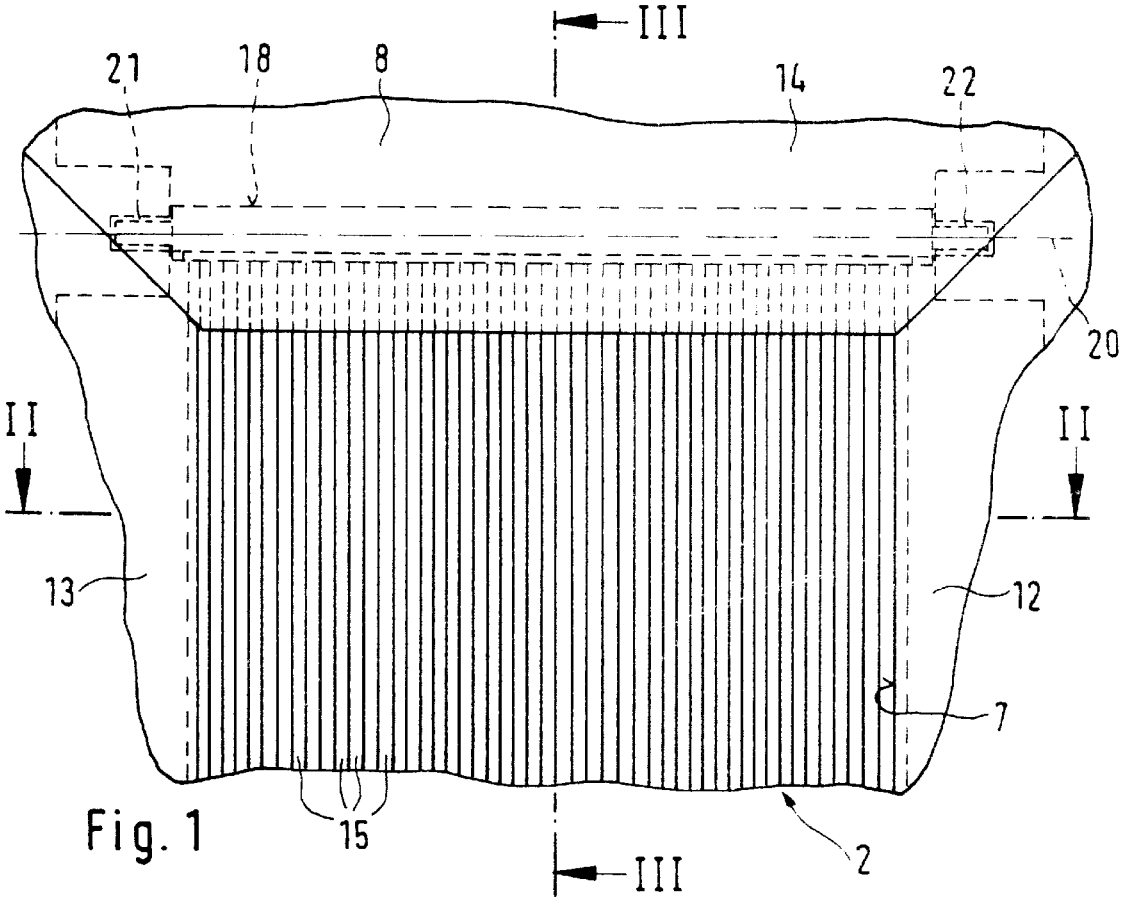
FIG. 1 illustrates a first exemplified embodiment of a projectile stopping device in accordance with the invention, seen in the direction of firing.

The projectile stopping device in accordance with the invention consists of an arrangement of a plurality of stopping curtains 2 to 6 disposed spaced apart from each other in the direction of firing 1, wherein a firing field 7 preferably reaching to the floor is enclosed in edge regions by a screen 8.

As seen in the firing direction 1, and at a distance behind the last stopping curtain 6, there is located a projectile-proof steel wall 9 on the sides of which facing away from the stopping curtain 6 is disposed an intermediate wall 10 consisting of a material acting in a sound-damping manner. A wall 11 consisting of a material conventionally used in high-rise building, and designed as an external or room-dividing wall forms the end of the projectile stopping device.

The screen 8 consists of at least two side parts 12, 13 which are formed identically to each other and define the sides of the firing field, and of a transverse part 14 defining the top of the firing field 7 and adjoining the side parts 12, 13 on both sides. The side parts 12, 13 and the transverse part 14 consist of planar steel plates which are disposed inclined at an acute angle with respect to the direction of firing 1. The corresponding angle of inclination is measured in such a way that in the event of ricochets there is no danger from projectiles or projectile fragments ricocheting into the room. The screen 8 can also be attached, in a manner not shown in the drawing, to lateral limit walls consisting, for example of steel, which for their part are surrounded, as in the case of the rear side illustrated in FIG. 3, by intermediate walls of a material acting in a sound-damping manner.

Each stopping curtain 2 to 6 consists of a side-by-side arrangement of individual steel cables 15 which are suspended at the top and terminate slightly above the floor. The steel cables 15 therefore hang so as to swing freely. The steel cables 15 of all the stopping curtains 2 to 6 have the same diameter 16. The steel cables 15 of a stopping curtain 2 can be disposed in such a way that they are at a tangent to each other peripherally and in this way form a planar curtain which has no gaps in the firing direction 1. The steel cables 15 of two stopping curtains 3 positioned one behind the other in the firing direction 1 and spaced apart by a dimension 17 are disposed offset with respect to each other in such a way that one steel cable 15 of a stopping curtain is in each case located centrally with respect to two steel cables 15 of the stopping curtain preceding it in the firing direction 1. The dimension 17 is such that the open spacing between two stopping curtains 2, 3 corresponds at least to the greatest length of a projectile, of which more detail will be given later.

Figure 3:
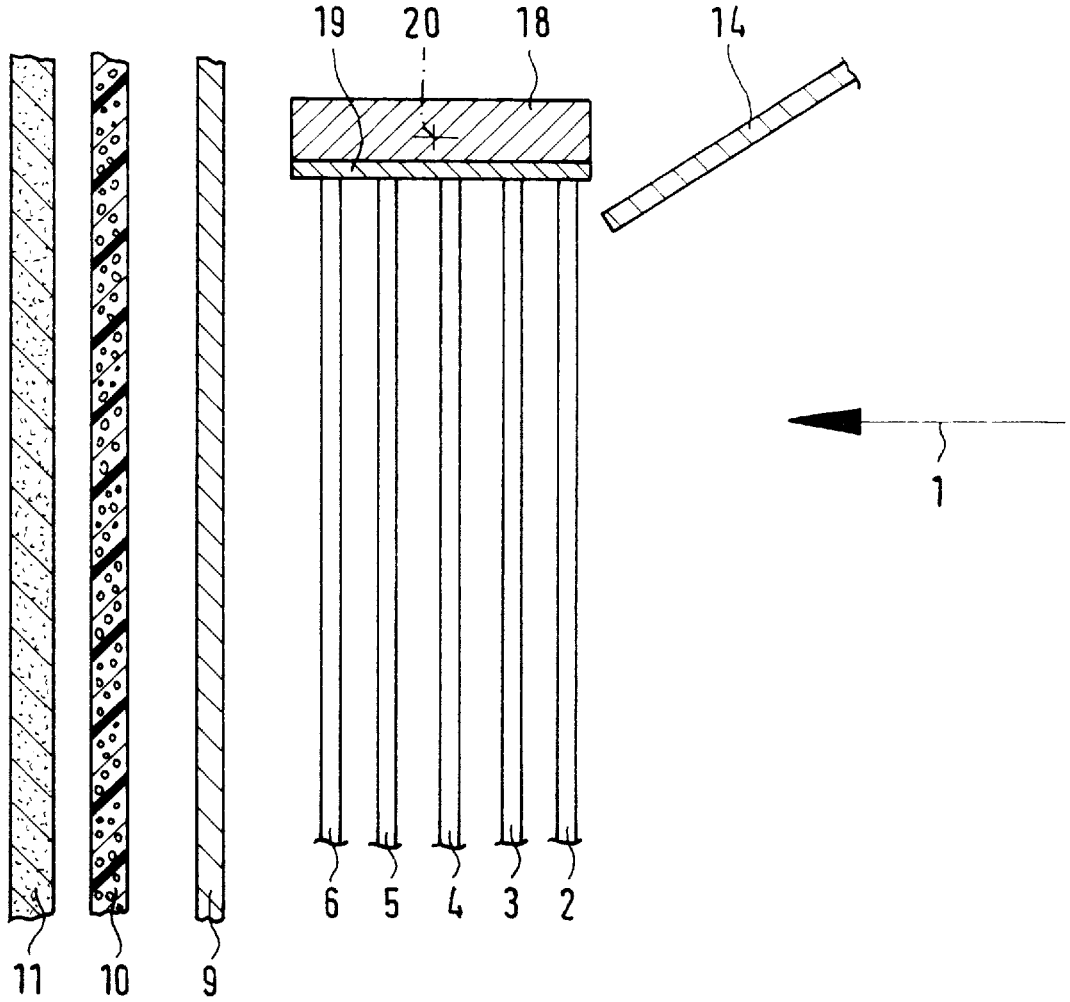
FIG. 3 illustrates a partial cross-sectional view of the projectile stopping device according to a vertical plane III—III of FIG. 1.

The reference number 18 designates a horizontally extending transverse carrier which, as shown in FIG. 3, can be of a generally rectangular shape and is provided on the underside with a device 19 for releasable attachment of the individual steel cables 15 of the stopping curtains 2 to 6. This device 19 can be fundamentally formed in any manner and is merely aimed at ensuring an arrangement of planar stopping curtains 2 to 6 according to the said spacing dimension.

The transverse carrier 18 is mounted at its two mutually opposite ends in journal bearings 21, 22 so as to be able to swing freely about its longitudinal axis 20 extending horizontally and parallel to the planes of the stopping curtains 2 to 6. These bearings 21, 22 are connected, in a suitable manner not illustrated further, to side walls which extend parallel to the firing direction 1.

The screen 8, the side walls, and the bearings 21, 22 are formed in such a way that a lateral swinging of the steel cables 15, i.e. in the direction of their respective plane, is equally possible without hindrance.

In the firing direction 1, projectiles contacting the projectile stopping device exert a displacing effect on the individual steel cables 15. According to the kinetic energy inherent in the projectiles, the contacted steel cable 15 is deflected perpendicular to the plane of the respective stopping curtain and/or within this plane. Both the deflection and the friction of the mutually tangential steel cables 15, in particular in the case of movements within the plane of the stopping curtain, irreversibly binds the energy of the projectile. The projectile, which is braked (decelerated) as a result of penetrating one or more stopping curtains finally falls to the floor between two successive stopping curtains.

The process of braking the projectiles as a result of contacting the steel cables of the stopping curtains takes place without much propagation of noise by reason of the damping properties of the steel cables. The size of the individual steel cables 15, in particular their cross-section, and the maximum caliber of the projectiles used are matched to each other in such a way that there is no risk of premature wearing of the steel cables and maintenance costs caused by having to exchange damaged steel cable can be kept within limits.

The projectiles and projectile fragments which have fallen to the floor between the steel cables, in particular between the stopping curtains, can also be disposed of easily, preferably by using simple catching containers on the floor.

Figure 2:
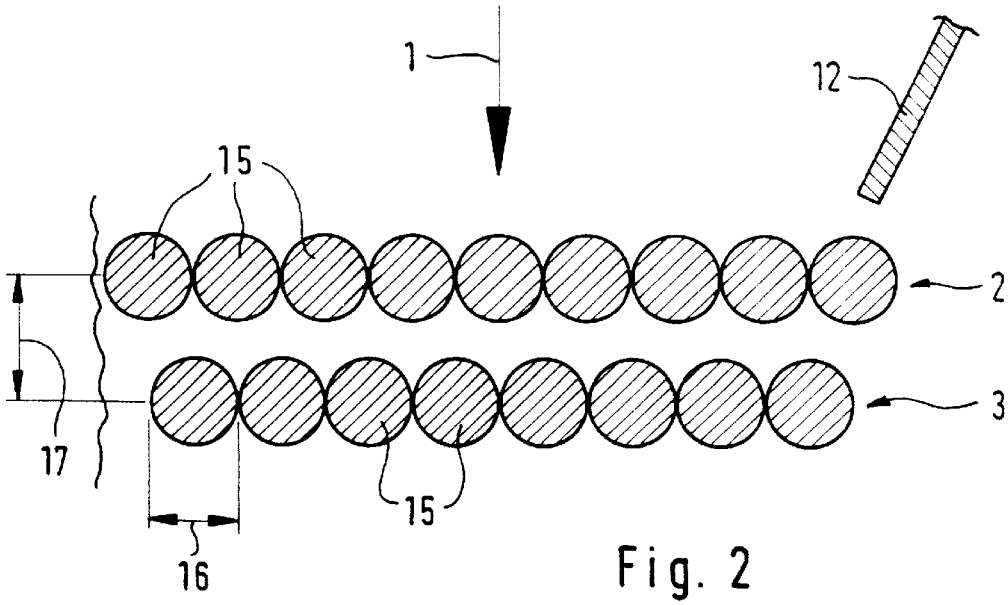
FIG. 2 illustrates a partial cross-sectional view of the projectile stopping device according to a horizontal plane II—II of FIG. 1.

In FIGS. 4 to 9, functional elements which correspond to those in FIGS. 1 to 3 are correspondingly referenced so that no repetitious description of them will be given.

Figure 4:
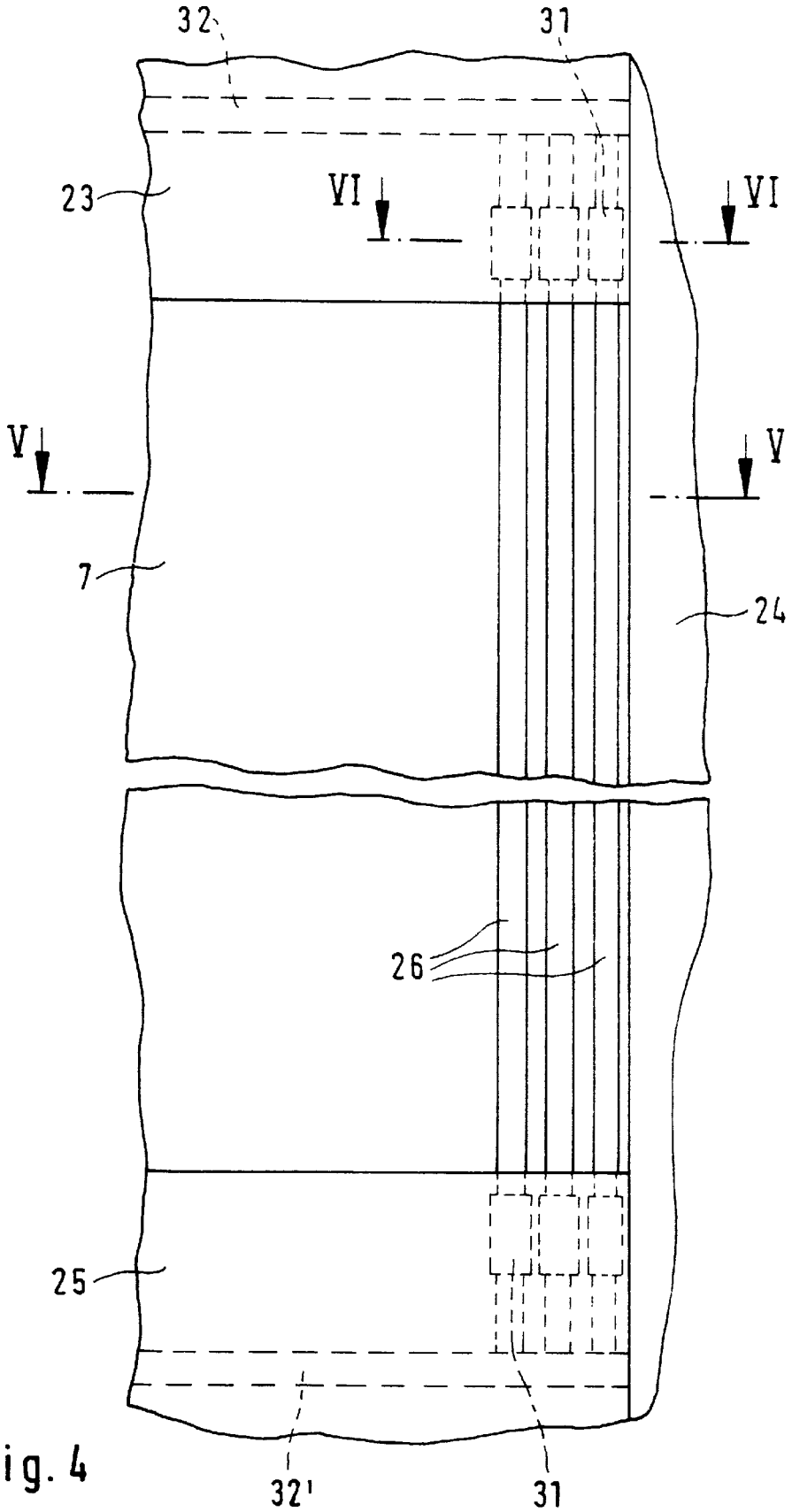
FIG. 4 illustrates a front view of a second exemplified embodiment of a projectile stopping device in accordance with the invention.

The square or rectangular firing or target field 7 of the projectile stopping installation shown in FIG. 4 is defined by upper edging plate 23, lateral edging plates 24 and a lower edging plate 25. All these edging plates extend at an angle to a vertical plane and are inclined inwards towards the middle of the target field 7 so that projectiles contacting the edging plates are deflected inwards in the direction of the target field 7. The edging plates 23, 24 can consist of steel or wood and are received in a frame structure not illustrated in the drawings, which is attached, for example, to the floor. No more detail will be given of this hereinunder.

In each case, the edging plates 23, 24 are formed in a projectile-proof manner. They protect the parts of the installation which are not intended to be fired at.

The target field 7 is characterized by a side by side arrangement of steel stopping cables 26, which are disposed in each case next to each other to provide, as seen in the firing direction 1, a plurality of mutually spaced curtains 27, 28 and 29. The stopping cables 26 are disposed within each of these curtains at a slight spacing from each other and in particular able to move with respect to each other in the plane of a curtain in dependence upon this spacing.

Furthermore, the stopping cables 26 of the individual stopping curtains 27 to 29 are in each case offset with respect to each other so that, seen in the firing direction 1, a stopping cable 26 of one curtain is located respectively opposite the gap between two stopping cables of the subsequent curtain.

Figure 5:
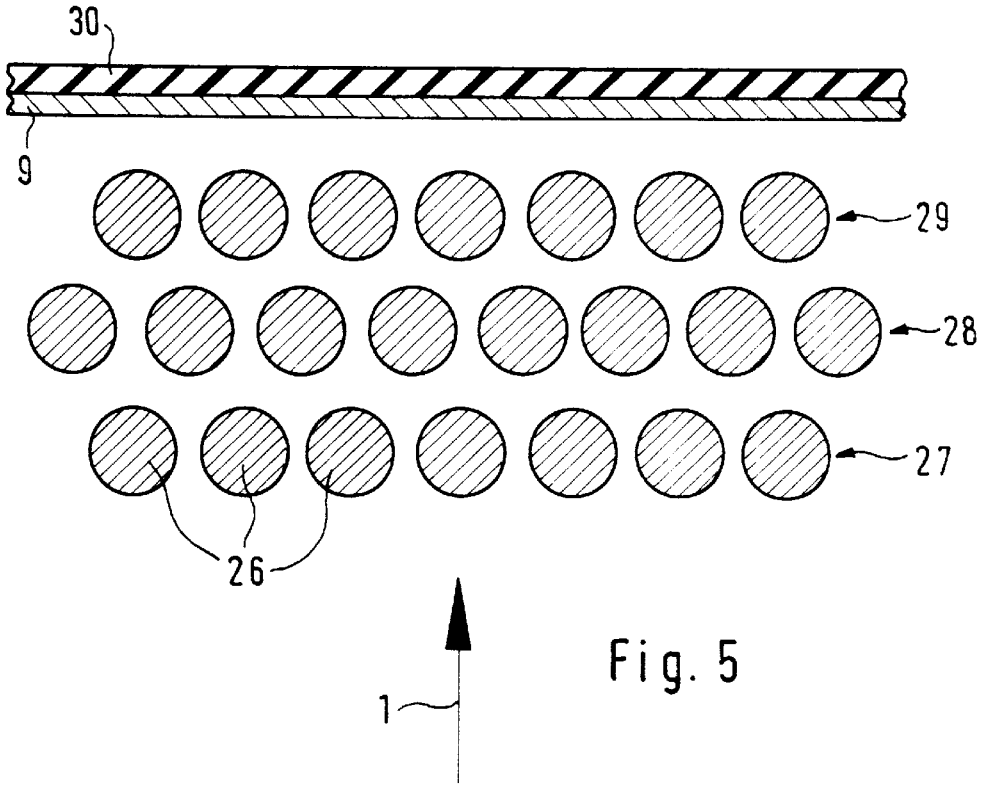
FIG. 5 illustrates a partial view of the projectile stopping device in a horizontal cross-sectional view according to a plane V—V of FIG. 4.

In FIG. 5, a total of three curtains 27, 28, 29 are shown. However, in individual cases there may also be more or less than three curtains. For safety reasons, a steel wall 9 forms the rear end of the projectile stopping installation and this steel plate 9 is of a thickness to prevent, in the worst case scenario, a projectile passing through the said plate even in the case of the most powerful projectiles. The steel wall or steel plate 9 extends at the top and bottom and laterally beyond the target field 7 and covers the whole region of the projectile stopping installation which may be used for firing projectiles. The number 30 designates a coating covering the rear of the steel plate 9 and consists of a sound-damping material such as rubber, cork or a synthetic foam, which coating serves to dampen sound and serves to attach the steel plate 9 in a frame structure not reproduced in the drawing.

In accordance with the invention, the stopping cables 26 are provided at their respective upper and lower ends with holding devices 31 by means of which they are held, in particular in upper and lower guides 32, 32' as explained in more detail below. The purpose of these guides 32, 32' is to return the stopping cables 26 to their rest position when they have been deflected out of this rest position in the firing direction 1 and/or perpendicular to the firing direction 1 as a result of being contacted by the projectiles. As a result of these guides, the stopping cables 26 are therefore not rigidly clamped in but suspended so as to yield in a defined manner and, according to the kinetic energy inherent in the contacting projectiles, to undergo a deflection. However, it is important that after each firing the stopping cables reassume a defined initial position, as a result of which uniform and reproducible projectile stopping properties are provided.

Figure 6:
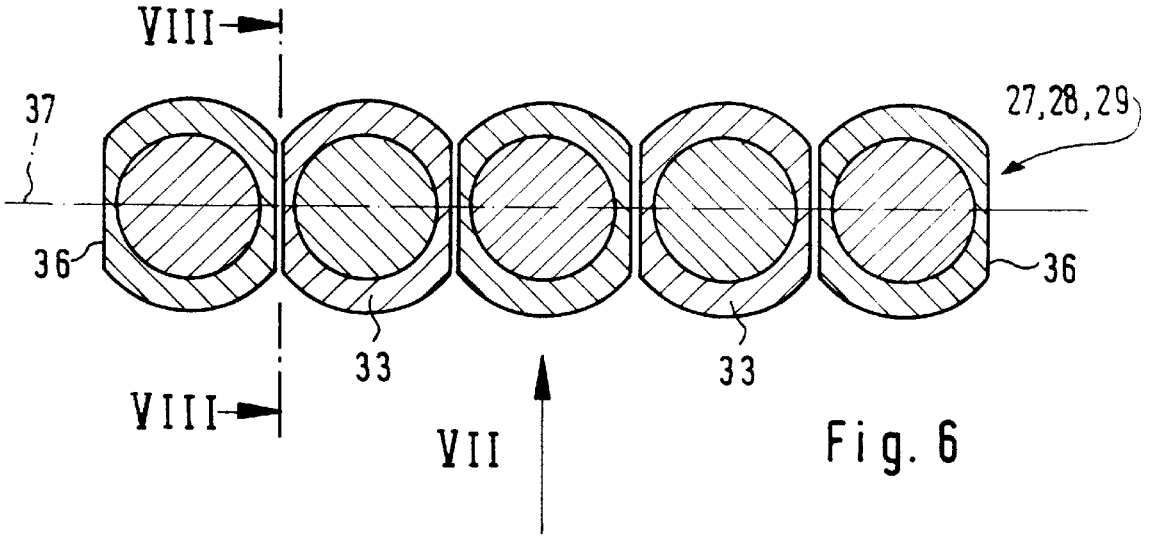
FIG. 6 illustrates a partial view of the upper region of the projectile stopping installation according to a horizontal cross—sectional plane VI—VI of FIG. 4.
Figure 8:
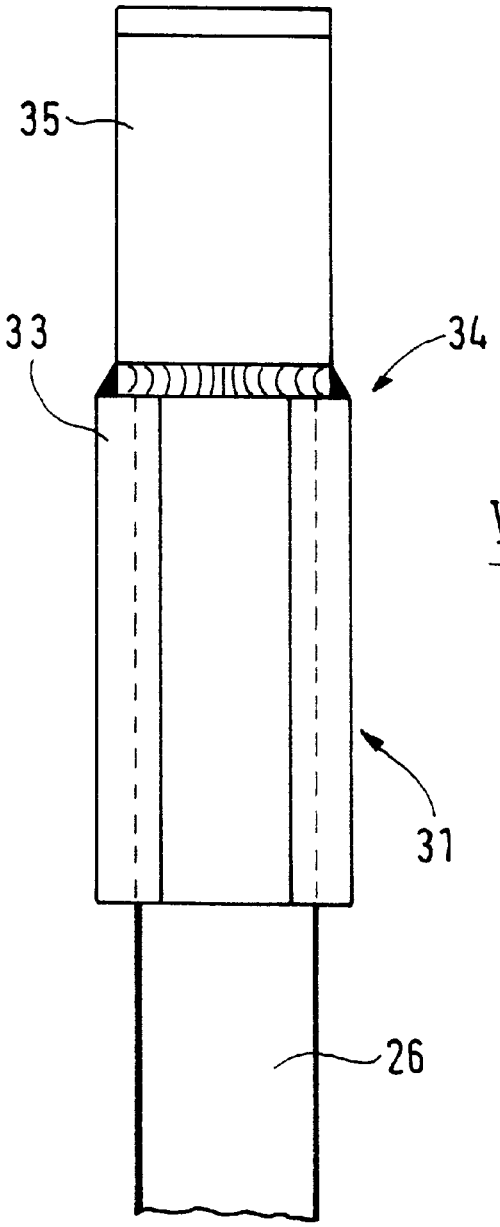
FIG. 8 illustrates a side view of the cable suspension according to a direction of view VIII of FIG. 7.
Figure 7:
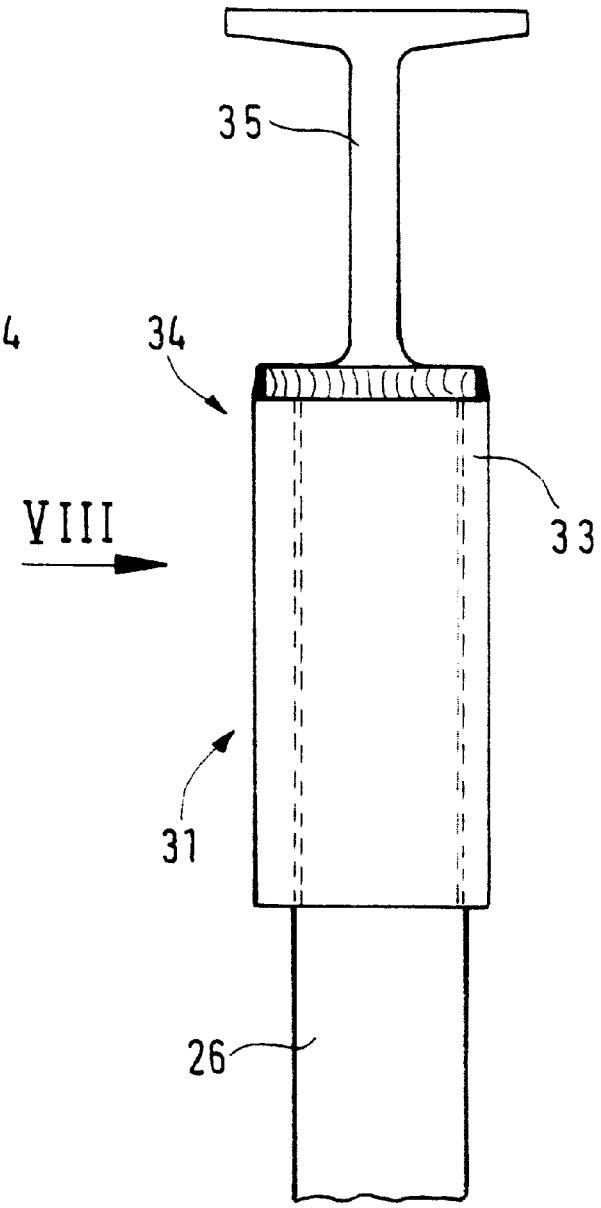
FIG. 7 illustrates a diagram showing the principle of a cable suspension in accordance with the invention according to a direction of view VII—VII of FIG. 6.

In order to explain the holding devices 31, reference will be made hereinunder to FIGS. 6 to 8 of the drawings.

Each of the holding devices 31, which are formed the same as each other at the top and bottom, consists of a substantially cylindrical receiving part 33, on the upper end 34 of which a holding profile 35 is positioned. The holding profile 35 is non-releasably attached to the receiving part 33 and is preferably welded thereto. A stopping cable 26 is inserted into the lower end of the receiving part 33 and extends into the upper end 34. The connection of the stopping cable 26 to the receiving part 33 can take place in a particularly advantageous manner at the same time as the production of a welded connection between the holding profile 35 and the receiving part 33 so that the end of the stopping cable 26 is also bound into this welded connection.

The latter type of connection between the stopping cable 26 on the one hand and the receiving part 33 on the other has proved to be of practical advantage and in particular to be able to withstand extremely high loading. However, it is fundamentally possible to use any techniques to produce a connection between the stopping cable 26 and the holding device 31, which connection is adapted to suit the purpose of the invention and, in particular, can be subjected to loads accordingly.

Each open receiving part 33 is provided on two mutually opposite sides with flattened regions 36 which are the same as each other so that each receiving part 33 is symmetrical with respect to a middle plane 37. This formation makes it possible to dispose the receiving parts 33 of each of the curtains 27 to 29 in such a way that their receptive flattened regions 36 lie opposite each other and, in particulars with the smallest possible spacing o that consequently within a curtain the lateral spacing of the stopping cables 26 in their rest position is again as small as possible.

Figure 9:
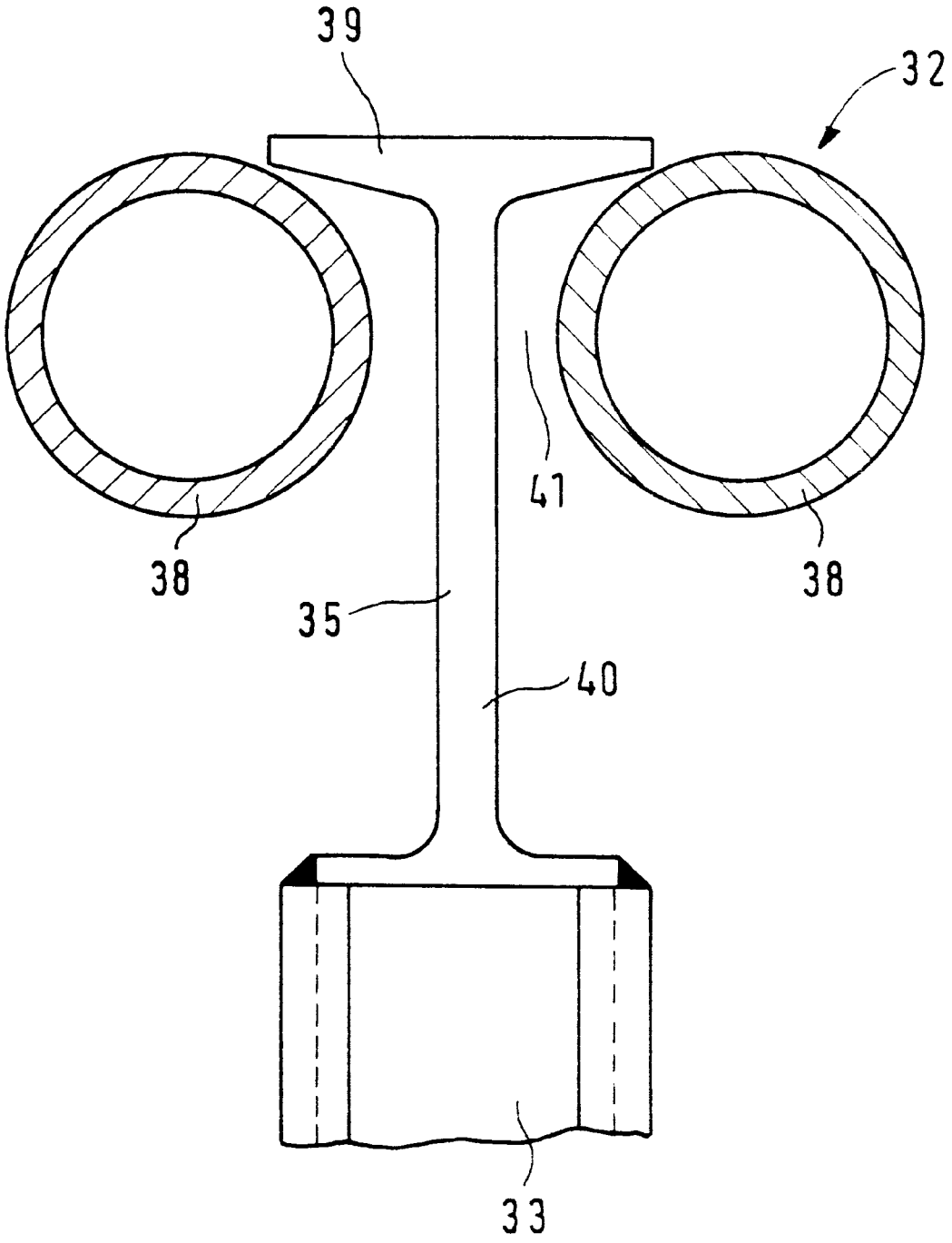
FIG. 9 illustrates an enlarged illustration explaining the manner in which the cable suspension works, according to a drawing plane corresponding to FIG. 7.

FIG. 9 shows, merely by way of example, the formation of a guide 32 on which, by means of the receiving parts 33, the curtains 27 to 29 are suspended at the top. Similar guides 32' are located at the bottom of the target field 7 and the stopping cables 26 are connected to these lower guides 32' in the same way by means of receiving parts 33. Because the two guides 32, 32' are the same, the description hereinunder is limited to the upper guide 32 shown in FIG. 9.

An essential feature of the guide 32 is formed by two carrier pipes 38 which extend parallel to each other at a spaced disposition and guide the holding profile 35 which has a double-T shape. This guidance takes place in such a way that the upper, horizontally extending transverse web 39 of the holding profile 35 lies on the facing upper surface portions of the carrier pipes 38 so that the middle web 40 of the holding profile 35 extends through the intermediate space 41 between the carrier pipes 38 which are formed in an identical manner to each other. This means that the carrier pipes 38 are received in a frame structure (not illustrated) in such a way that the individual holding profiles 35 can be pushed one after the other into the operating position shown in FIG. 9 from the end-face ends of the carrier pipes 38. Fundamentally, two such carrier pipes 38 are allocated to each of the curtains 27 to 29 shown in FIG. 5. It is also possible, however, to suspend the holding profiles of two different curtains respectively on one carrier pipe 38.

Moreover, the individual stopping cables are suspended using such guides 32, 32' in such a way that the carrier cables are not rigidly clamped in the respective operating position but have a certain amount of play, seen in the longitudinal direction, so that the possibility exists that, as a result of a projectile contacting the individual carrier cable, the individual carrier cable can be deflected in the firing direction and/or perpendicular to this direction. The cable can then subsequently swing back, under the effect of gravity, to its initial position. This swinging back takes place under a greater or lesser degree of damping according to the geometry of the mutually engaged surfaces of the transverse webs 39 of the holding portions 35 on the one hand and the surface portions, facing these holding portions, of the carrier pipes 38 on the other. These surface portions which interact with each other can, in particular, be arranged with a view to such damping. This can take place, for example, by means of the surface roughness of these surface portions in conjunction with their geometric formation or by a friction-increasing coating.

By reason of the upper and lower guidance of the individual stopping cables, their possibilities for movement as a result of the contacting projectiles are limited. There is always a restoring force returning them to their initial position. The stopping cables are disposed relatively densely within a curtain in the initial position but can equally be deflected slightly in the longitudinal direction of the carrier pipes when the holding profile 35 is tilted. Because a steel plate 9 forming the rearward end of the projectile stopping installation is attached in a frame structure by interpositioning of a layer 30 consisting of a sound-damping, for example elastomeric, material, the sound caused by the projectile contacting the steel plate 9 is significantly damped and, in particular, is not propagated.

The projectiles falling to the floor between the stopping cables can easily be collected after the projectile stopping installation has been used and can be disposed of in the appropriate manner.

It is easy to dispose of individual stopping cables which may have become damaged. Namely, the stopping cable is pulled out from the carrier pipes 38 at the end-face. Because the steel cables are guided perfectly at the top and bottom, this removal of individual stopping cables is also comparatively easy, since there is no risk of the individual stopping cables twisting together as a result of projectiles contacting them and as a result of uncontrolled deflection movements caused thereby so that the removal of individual stopping cables could also cause problems as a result of their relatively considerable weight. The exemplified embodiment illustrated with the aid of the description given above can be varied in many ways. It is possible, for example, to dispense with the receiving device of the guide 32' so that the ends of the stopping cables allocated thereto are merely passed through the intermediate space between two mutually adjacent carrier pipes and in this way are guided. Spacing pieces can also be provided at the ends. However, when using this guide means, it is possible to dispense with these spacing pieces.

What is claimed is:

1. A projectile stopping device for decelerating projectiles and recovering them for disposal purposes, said device comprising:

a first stopping curtain;

a second stopping curtain disposed behind said first stopping curtain relative to a firing direction;

wherein each of said stopping curtains comprises a side by side arrangement of steel cables and are mounted on a transverse carrier; and wherein said transverse carrier is mounted to be capable of swinging freely about a horizontal longitudinal axis.

2. The projectile stopping device of claim 1, wherein said steel cables of at least one of said stopping curtains are peripherally tangential to each other.

3. The projectile stopping device of claim 1, further defining a firing field, wherein said steel cables of said first stopping curtain are disposed offset from said steel cables of said second stopping curtain such that there are substantially no gaps in the firing field through both said first and second stopping curtains in the firing direction.

4. The projectile stopping device of claim 1, wherein said steel cables of each respective stopping curtain have a substantially same diameter and said steel cables of said first and second stopping curtains have diameters different from each other.

5. The projectile stopping device of claim 1, wherein said steel cables of said first and second stopping curtains are releasably connected to said transverse carrier.

6. The projectile stopping device of claim 1, wherein said steel cables are suspended to permit free swinging movement to all sides.

7. The projectile stopping device of claim 1, wherein the steel cables of said stopping curtains that follow one behind the other in the firing direction extend parallel to each other.

8. The projectile stopping device of claim 1, wherein said steel cables of said stopping curtains extend vertically, and said stopping curtains are disposed at an acute angle to the firing direction.

9. The projectile stopping device of claim 1, wherein said stopping curtains, seen from a viewpoint trnasverse to the firing direction, are inclined toward the firing direction.

10. The projectile stopping device of claim 1, wherein said steel cables of said stopping curtains extend vertically at an acute angle with respect to the firing direction, and are inclined toward the firing direction as seen from a viewpoint transverse to the firing direction.

11. The projectile stopping device of claim 1, wherein all components of the projectile stopping device are held in a frame structure; and wherein said stopping device has a firing field which is at least partially enclosed by projectile-proof edging plates.

12. A projectile stopping device for decelerating projectiles and recovering them for disposal purposes, said device comprising:

a first stopping curtain;

a second stopping curtain disposed behind said first stopping curtain relative to a firing direction;

wherein each of said first and second stopping curtains comprises a side by side arrangement of steel cables and is held in a guide at its upper end; and wherein the steel cables of each stopping curtain are held at a defined spacing with respect to each other by spacers located at their lower ends, the connection between each steel cable and said guide is formed in such a way that in cooperation with the spacers a defined deflection of the steel cable from its rest position both in the firing direction and also perpendicular to the firing direction is possible against a return force.

13. The projectile stopping device of claim 12, wherein each steel cable is held in a guide at both its upper and lower ends.

14. The projectile stopping device of claim 12, further comprising a receiving device connected to each end of a steel cable, said receiving device being releasably held in a respective guide at each end.

15. The projectile stopping device of claim 14, wherein each said receiving device comprises:

a pipe-like receiving part for receiving one steel cable end; and a holding profile; wherein said holding profile connects said receiving part and said guide at said one cable end; and wherein said one cable end is fixed in said receiving part.

16. The projectile stopping device of claim 14, wherein the receiving devices are provided on both ends of each of said plurality of steel cables are formed in the same way.

17. The projectile stopping device of claim 15, wherein each said receiving device comprises a holding profile connecting said receiving part and said guide, and wherein said guide is formed by two mutually adjacent carrier pipes and said holding profile extends through a space intermediate two mutually adjacent carrier pipes and at its end facing away from said steel cables engages both carrier pipes.

18. The projectile stopping device of claim 15, wherein each said receiving device comprises a respective holding profile connecting said receiving part and a respective guide, and wherein said respective guide is formed by a carrier pipe which is partially surrounded by said holding profile.

19. The projectile stopping device of claim 15, each of said pipe-like receiving part is formed by a pipe cylinder which is externally flattened on two sides which lie diametrically opposite each other; and wherein within a stopping curtain the pipe cylinders are disposed such that two such flattened surfaces lie opposite each other.

20. The projectile stopping device of claim 13, wherein said stopping curtains extend along a physically curved surface defined at the ends of the steel cables by a cooresponding curvature of the upper and lower guides.

21. The projectile stopping device of claim 12, wherein said guide is formed by an arrangement of carrier pipes or rails which are disposed outside a firing field.

22. A projectile stopping device for decelerating projectiles and recovering them for disposal purposes, said device comprising:

a first stopping curtain;

a second stopping curtain disposed behind said first stopping curtain relative to a firing direction;

wherein each of said stopping curtains comprises a side by side arrangement of steel cables; and wherein the steel cables of said stopping curtains that follow one behind the other in the firing direction extend at an angle other than parallel to each other.

23. A projectile stopping device for decelerating projectiles and recovering them for disposal purposes, said device comprising:

a first stopping curtain;

a second stopping curtain disposed behind said first stopping curtain relative to a firing direction, said first and second stopping curtains comprising a side by side arrangement of steel cables; and a screen comprising plates which frame a firing field, said plates extending at an acute angle to the firing direction and framing the firing field at least laterally and at the top.

24. The projectile stopping device of claim 23, further comprising projectile-proof plates, said projectile proof plates rearwardly and laterally enclosing said stopping curtains.

* * * * *